US006006985A

United States Patent [19]

Hawkins

[11] Patent Number: 6,006,985

[45] Date of Patent: Dec. 28, 1999

[54] EASY OPENING ENVELOPE WITH TEAR PANEL

[75] Inventor: Michael Hawkins, 406 E. Margarita Rd., Rialto, Calif.

[73] Assignee: Michael Hawkins, Rialto, Calif.

[21] Appl. No.: 09/052,349

[22] Filed: Mar. 30, 1998

[51] Int. Cl.[6] ..... B65D 27/34

[52] U.S. Cl. ..... 229/313

[58] Field of Search ..... 229/313, 314, 229/315, 316

[56] References Cited

U.S. PATENT DOCUMENTS

| | | | |
|---|---|---|---|
| 286,881 | 10/1883 | Weaver . | |
| 570,380 | 10/1896 | Chalmers | 229/313 |
| 754,201 | 3/1904 | Davalos . | |
| 877,330 | 1/1908 | Harvey . | |
| 895,520 | 8/1908 | Virkus . | |
| 1,306,224 | 6/1919 | Godley | 229/313 |
| 1,511,886 | 10/1924 | Hinchman | 229/313 X |
| 1,550,750 | 8/1925 | Shannon . | |
| 2,021,620 | 11/1935 | Weir . | |
| 2,087,410 | 7/1937 | Lane et al. . | |
| 2,092,149 | 9/1937 | Berkowitz . | |
| 2,310,371 | 2/1943 | Lines et al. . | |
| 2,527,925 | 10/1950 | Frampton . | |
| 2,859,907 | 11/1958 | McFarland . | |
| 3,190,540 | 6/1965 | Shade . | |
| 3,392,905 | 7/1968 | Caldwell . | |
| 3,620,441 | 11/1971 | Robbins | 229/316 |
| 3,650,463 | 3/1972 | Christiansen et al. . | |
| 3,853,262 | 12/1974 | Tucker et al. . | |
| 3,888,408 | 6/1975 | Clipner . | |
| 4,166,538 | 9/1979 | Nixon et al. . | |
| 4,166,539 | 9/1979 | Allen et al. . | |
| 4,470,511 | 9/1984 | Meeker et al. . | |
| 4,819,807 | 4/1989 | Giger . | |
| 5,163,612 | 11/1992 | Ashby . | |
| 5,499,757 | 3/1996 | Back . | |
| 5,791,556 | 8/1998 | Hawkins | 229/313 |

FOREIGN PATENT DOCUMENTS

| | | | |
|---|---|---|---|
| 800441 | 12/1988 | Canada | 229/313 |
| 579054 | 10/1924 | France | 229/313 |
| 2457225 | 12/1980 | France | 229/313 |
| 492399 | 5/1937 | United Kingdom . | |
| 510989 | 6/1938 | United Kingdom . | |
| 575866 | 3/1946 | United Kingdom | 229/313 |

*Primary Examiner*—Jes F. Pascua

*Attorney, Agent, or Firm*—The Brotman Group; R. Dabney Eastham

[57] ABSTRACT

An envelope has a tear panel created by lines of perforations that begin on either side of a pull tab formed in one or more of the panels of the envelope and divergingly extend away from the pull-tab. The pull-tab is conveniently grasped to exert a force that will detach the tear panel along the lines of perforations in order to readily inspect and extract the contents of the envelope.

4 Claims, 14 Drawing Sheets

EASY OPENING ENVELOPE WITH TEAR PANEL

CROSS-REFERENCE TO PROVISIONAL APPLICATION

This application is related to my co-pending provisional application no. 60/042,258 filed on Mar. 31, 1997, which is specifically incorporated by reference.

BACKGROUND OF THE INVENTION

An envelope is a container, usually made of folded paper, which is designed to enclose documents or other substantially flat objects for the purposes, among others, of keeping these contents together and preventing their inspection by others during transmission to a recipient. The most commonly used envelopes, such as the COM-10 business envelope, are made of a single sheet of paper folded along four lines to form a front panel, side flaps, a back panel, and a closure flap. The side flaps are adhesively secured to the back panel. A sealing edge on the interior surface of the closure flap is usually provided with adhesive for the purpose of sealing the closure flap to the back panel after the envelope has received its contents in the pocket formed by the front panel, side flaps, and back panel.

This design of envelope is simple and inexpensive. The procedures for removing the contents of an envelope of this design, however, usually involve cutting or tearing the closure flap or other portions of the envelope, separating the front panel from the back panel, and reaching inside to remove the contents.

A need exists for an envelope that has opening means situated so as be readily operable without tools and accessible to the user. It should be designed to expose the contents of the envelope in order to facilitate removal of those contents.

SUMMARY OF THE INVENTION

My invention provides an envelope with opening means that are easy to use and facilitate the inspection and removal of the contents of the envelope. The envelope is constructed from a single sheet or blank of material folded to make four, and preferably five, panels that are attached to each other to form the envelope. Two lines of perforations commence on either side of a pull tab formed in one or more of the panels and divergingly extend away from the pull tab to create a tear panel wider than the pull tab. The envelope, after sealing, may be opened by pulling on the pull tab and causing the tear panel to separate at the lines of perforations, thus exposing the contents of the envelope for inspection and easy removal.

An embodiment of the easy-opening envelope according to my invention comprises a substantially rectangular planar front panel having opposed inner and outer surfaces, a top edge, a bottom edge, and first and second opposed side edges. The front panel has first and second side panels (the second side panel is optional) hingedly connected respectively to the first and second side edges of the front panel, the first and second side panels each having an inner and an outer surface, with the inner surfaces of the first and second side panels being adjacent the inner surface of the front panel.

A back panel has opposed inner and outer surfaces, a bottom edge, a top edge, first and second opposed side edges adjacent, respectively, to the first and second side edges of the front panel, the bottom edge of the back panel being hingedly connected to the bottom edge of the front panel, and the inner surface of the back panel being adhesively attached to the outer surfaces of the first and second side panels respectively (or to the front panel, if the second side panel is omitted). The back panel has a line of perforations commencing generally just below the intersection of the first side edge of the back panel and the top edge of the back panel and extending to the second side edge of the back panel, the line of perforations diverging away from the top edge of the back panel.

A closure panel has opposed inner and outer surfaces, a side edge adjacent the first side edge of the front panel, a top edge hingedly connected to the top edge of the front panel, a sealing edge paralleling the top edge of the back panel, and a line of perforations parallel to the sealing edge and generally coincident with the top edge of the back panel when the closure panel is in sealing engagement with the back panel.

The portions of the closure panel and the back panel in sealing engagement between the lines of perforations form a tear panel for opening the envelope after sealing and thus revealing the contents of the envelope. The pull tab is formed from portions of the back panel or the closure panel or both at the juncture of the back panel and the closure panel adjacent to the first side edge of the front panel. The back panel or the closure panel or both may be indented at these portions to provide a pull tab that is easily gripped between thumb and forefinger. Alternatively or in addition, the back panel or the closure panel or both may have extensions at their juncture adjacent the first side edge of the front panel which will serve as a more easily grasped pull tab.

The tear panel can also be formed in the front panel, in the back panel, the side panels or in the closure panel, or in combinations of these panels.

The invention will be explained in detail below by description of preferred and alternative embodiments.

DETAILED DESCRIPTION OF THE PREFERRED EMBODIMENT

Figure 1:
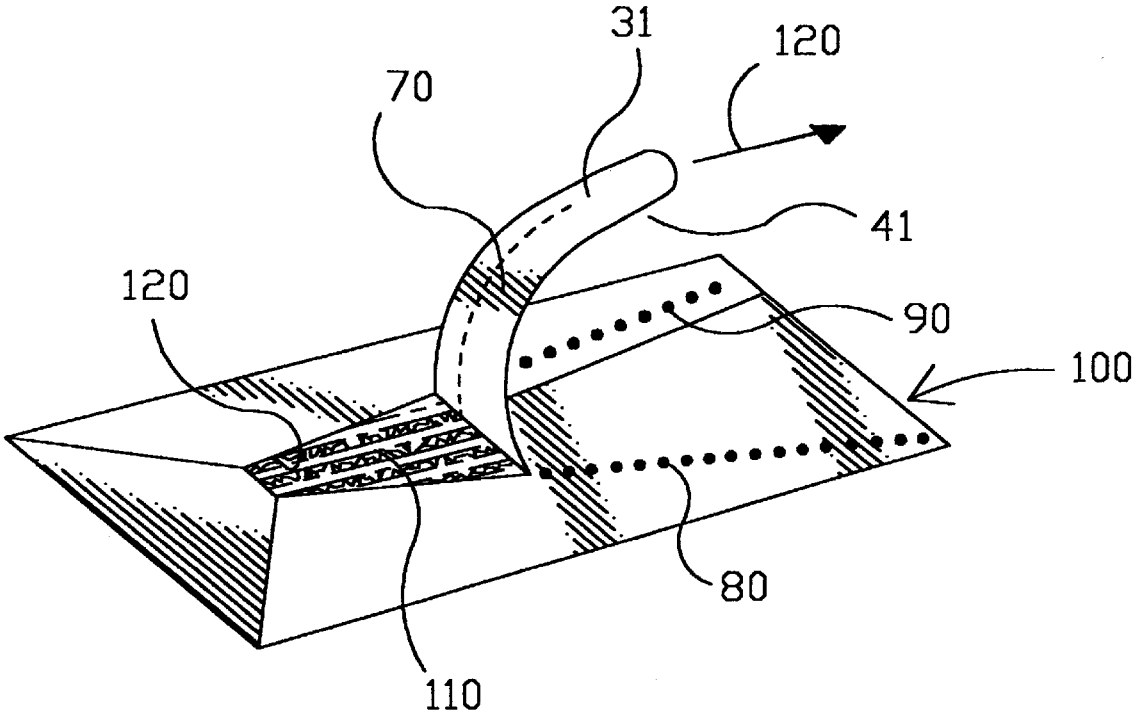
FIG. 1 is a perspective view of a preferred embodiment of the envelope according to the invention.

FIG. 1 shows a preferred embodiment of an easy-opening envelope 100 according to the invention with a tear panel 70 partly detached along diverging lines of perforations 80 and 90, by pulling in the direction indicated by arrow 120. The contents 110 of the envelope may be easily inspected and removed through the triangular-shaped aperture 120 after the tear panel 70 is separated from the remainder of the envelope 100 along lines of perforations 80 and 90.

Figure 2:
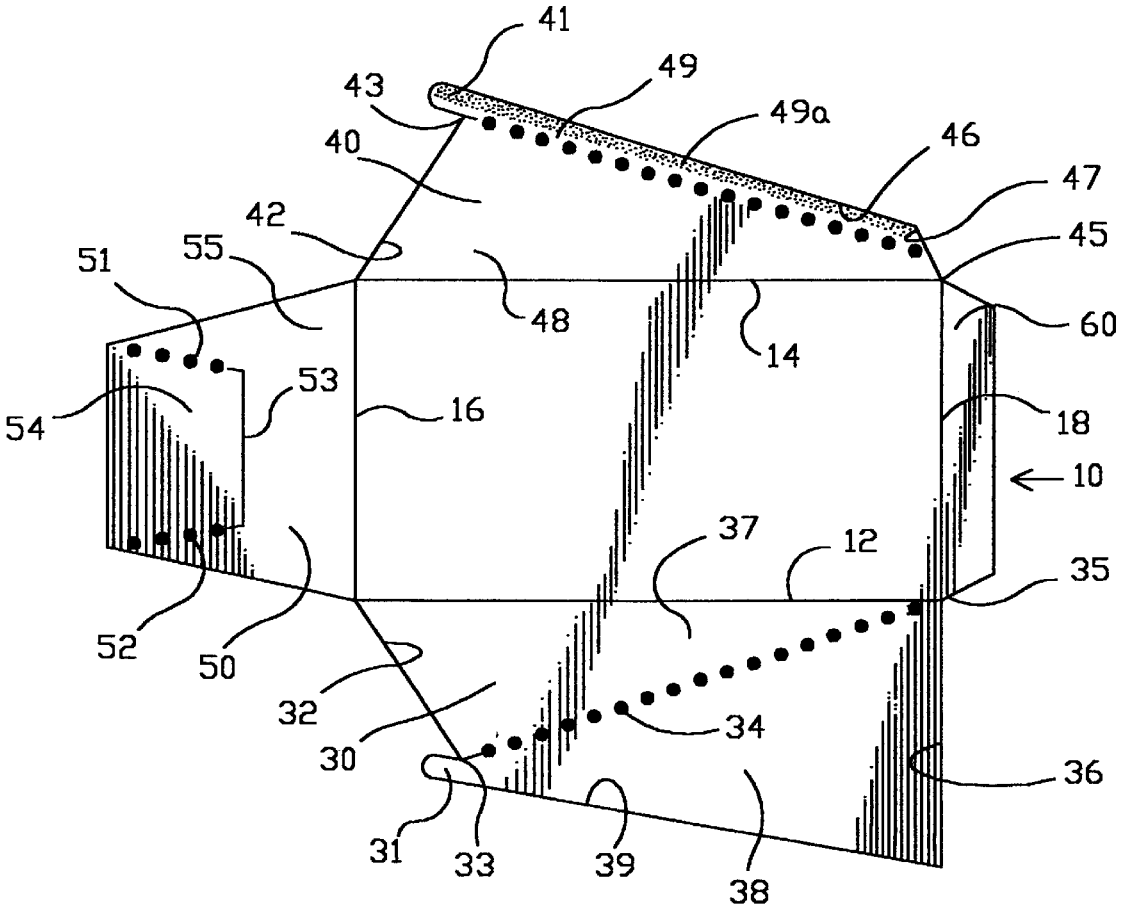
FIG. 2 is a plan view of a blank for forming the preferred embodiment of the envelope shown in FIG. 1.

Referring to FIG. 2, a blank for forming the preferred embodiment of the envelope 100 shown in FIG. 1 is indicated generally by reference number 10. The blank 10 is cut or punched from a single sheet of two-sided flat material such as paper or other material suitable for making envelopes. The blank 10 will be folded to form several panels.

The blank 10 shown in FIG. 2 has four fold lines 12, 14, 16, and 18. These fold lines form the bottom, top, first side edge, and second side edge, respectively, of the front panel 20. The front panel 20 joins the back panel 30 at the fold line 12, and the fold line 12 will be the bottom edge of the back panel 30. The closure panel 40 joins the front panel 20 at the fold line 14, and the fold line 14 will be the top edge of the closure panel 40. The first side panel 50 joins the front panel 20 at the fold line 16. The second side panel 60 joins the front panel 20 at the fold line 18. Only the inside surfaces of first panel 20, back panel 30, closure panel 40, first side panel 50, and second side panel 60 are shown in FIG. 2 (these surfaces will be on the inside of the envelope 100 when it is assembled and sealed).

The back panel. 30 has a projecting pull tab 31. The first side edge 32 of the back panel 30 slants at an acute angle to the fold line 12 to a juncture 33 with the pull tab 31. A line of perforations 34 extends from the juncture 33 to the intersection 35 of the fold lines 12 and 18. The line of perforations 34 (and the line of perforations 44 in the closure panel 40) is preferably formed in the blank 10 as part of the process of cutting the blank 10 from stock, by well-known apparatus and methods. The line of perforations 34 may intersect the second side edge 36 of the back panel 30 at some point other than intersection 35, although that intersection is preferred.

The line of perforations 34 divides the back panel 30 into a fixed segment 37 and a separable segment 38. The top edge 39 of the back panel 30 slants away from the fold line 12 in proceeding from the pull tab 31 to the intersection of the top edge 39 with the second side edge 36. The line of perforations 34 is partly separated or indented at its meeting with the juncture 33 so that less force will be required to commence separation of segments 37 and 38 along the line of perforations 34.

The closure panel 40 has a projecting pull tab 41. The first side edge 42 of the closure panel 40 slants at an acute angle to the fold line 14 to a juncture 43 with the pull tab 41. A line of perforations 44 extends from the juncture 43 to the intersection 45 of the fold lines 14 and 18, and divides the closure panel 40 into a fixed segment 48 and a separable segment 49. The sealing or bottom edge 46 of the closure panel 40 generally parallels the line of perforations 44 in the closure panel 40. A second side edge 47 of the closure panel 40 slants inwardly at an acute angle to the fold line 14. The line of perforations 44 is partly separated at its meeting with the juncture 43 so that less force will be required to commence separation of segments 48 and 49 along the line of perforations 44.

Figure 4:
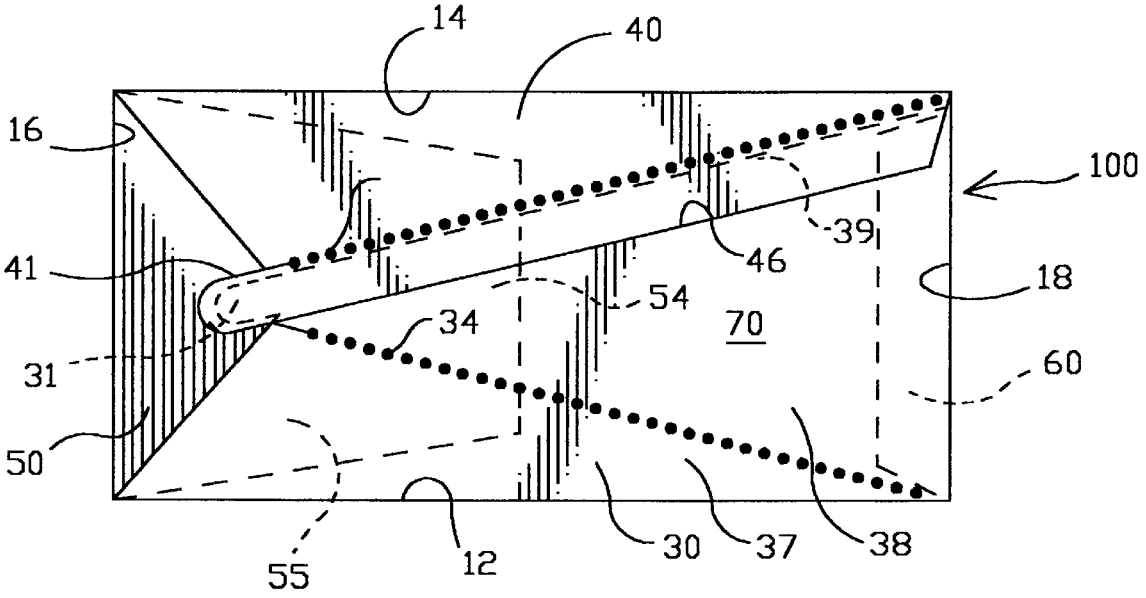
FIG. 4 is a plan view of the preferred embodiment of the envelope shown in FIG. 1, viewed from the back with the side panels, back panel, and closure panel folded onto the front panel to form the assembled envelope.

The separable segment 49 of the closure panel 40 is coated with a layer of glue 49*a*, which, when moistened, will attach the closure panel 40 to the back panel 30. (A layer of glue may also be applied to the closure panel 40 adjacent the first side edge 42 in order to seal the closure panel 40 to the first side panel 50.) The first side panel 50 is generally larger in size than the second side panel 60 in order to prevent inspection of the contents of the envelope 100 when the closure panel 40 is sealed to the back panel 30 (as is best shown in FIG. 4) and contains first and second lines of perforations 51 and 52 joined by a hooked slot 53 cut through the first side panel 50. The first and second lines of perforations 51 and 52 and the slot 53 divide the first side panel 50 into a separable segment 54 and a fixed segment 55.

As will be seen in subsequent figures in the drawings, the dimensions and shapes of the back panel 30, the closure panel 40, and the first side panel 50 are selected so that the blank 10 can be formed into an envelope 100 for containing articles such as papers and the like.

Figure 3:
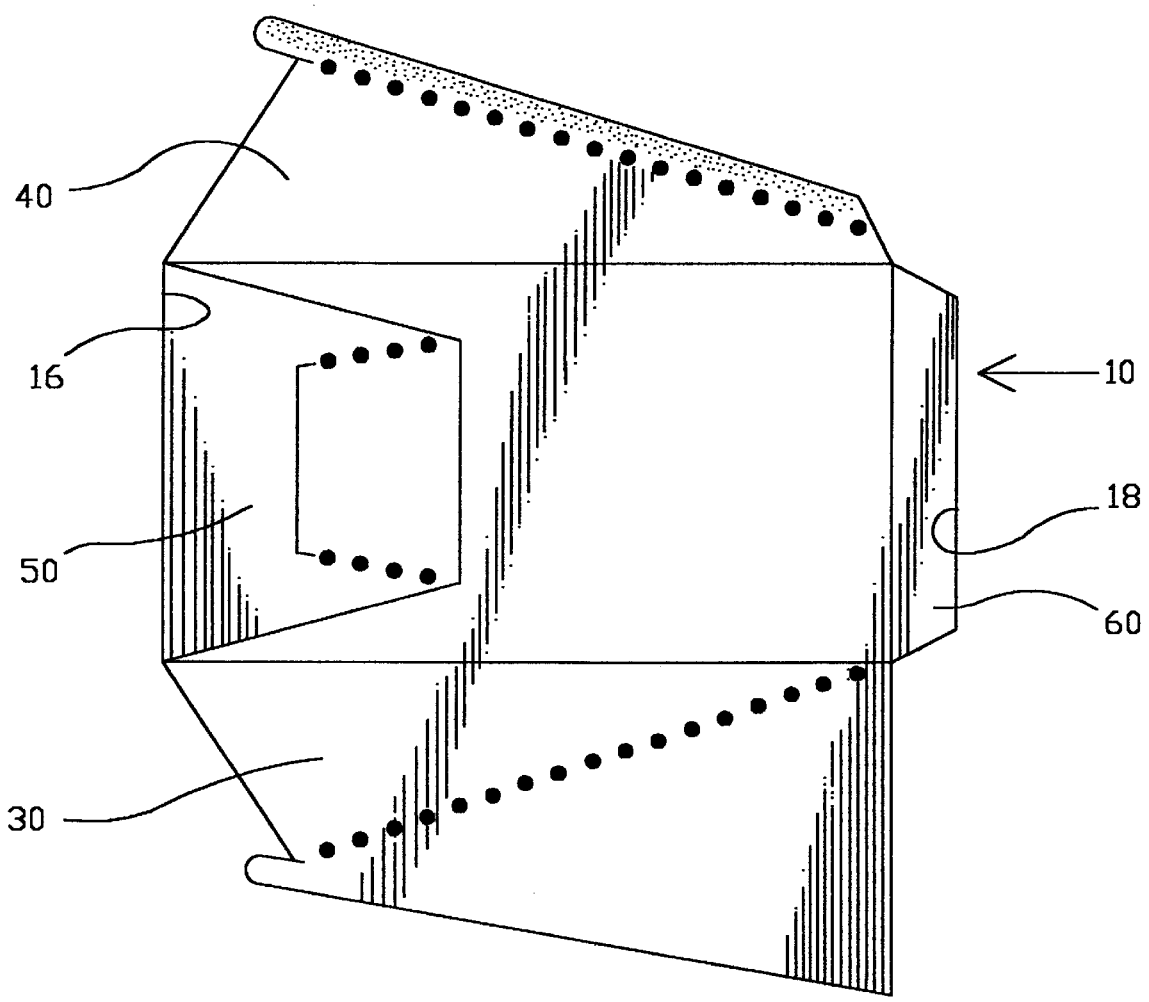
FIG. 3 is a plan view of the blank shown in FIG. 2 with the side panels folded in to the front panel.

FIG. 3 shows a step in the formation of the easy opening envelope 100 according to this preferred embodiment of the invention. The first side panel 50 and the second side panel 60 are folded inward to the front panel 20 so that the inside surfaces of the first and second side panels 50 and 60 are adjacent the inside surface of the front panel 20.

FIG. 4 shows the back of the assembled envelope 100. The bottom edge 46 of the closure panel 40 overlaps the top edge 39 of the back panel 30 so that the separable segment 49 of the closure panel 40 overlaps the separable segment 38 of the back panel 30 and can be fastened to it by moistening the glue layer 49*a* on the separable segment 49. The pull tabs 41 and 31 overlap and are fastened to each other by the glue layer 49*a*. Both the closure panel 40 and the back panel 30 overlap the first side panel 50 and the second side panel 60, respectively. The back panel 30 is glued to those portions of the first side panel 50 and the second side panel 60 that the back panel 30 overlaps, using well-known techniques and glues.

Once the envelope 100 is assembled as shown in FIG. 4, the line of perforations 52 in the first side panel 50 underlies and is coincident with a portion of the line of perforations 34 in the back panel 30. The line of perforations 51 in the first side panel 50 underlies and is coincident with a portion of the line of perforations 44 of the closure panel 40. The separable segment 49 of the closure panel 40 will be sealingly engaged to the separable segment 38 of the back panel 30, which in turn is glued to the separable segment 54 of the first side panel 50. The combination in the assembled and sealed envelope 100 of the separable segments 49, 38, and 54 of the closure panel 40, the back panel 30, the first side panel 50, and the second side panel 60, respectively, forms a tear panel 70 between diverging lines of perforations 34, 52, 44 and 51. The overlapping lines of perforations 34 and 52 separate or diverge from the overlapping lines of perforations 44 and 51 as these various combined lines of perforations extend away from the combined pull tabs 31 and 41.

As is best seen in FIG. 1, the recipient of the envelope 100 may expose the contents 110 of the envelope 100 for easy inspection and removal by grasping the combined pull tabs 41 and 31 and pulling them away from the envelope 100 and in the direction of the second side panel 60 (left to right as seen in FIG. 4) in order to sever the tear panel 70 from the fixed segment 37 of the bottom panel 30, the fixed segment 48 of the closure panel 40, and the fixed segment 55 of the first side panel 50 at the lines of perforations 34, 52, 44 and 51, and thereby expose the contents of the envelope through the triangular aperture 120 (see FIG. 1) in the envelope 100. The tear panel 70 will remain attached to the envelope 100 because the separable segment 38 of the back panel 30 is glued to the second side panel 60. As shown in FIG. 4, the combined pull tabs 41 and 31 are recessed from the first side edge 16 of the front panel 20 and are located about half-way between the top edge 14 and the bottom edge 12. My co-pending application Ser. No. 08/879,671 filed on Jun. 23, 1997, and allowed on Mar. 10, 1998, the disclosure of which is specifically incorporated by reference, describes how the integral pull tab for the tear strip of an envelope should be located no closer to the top edge of the front panel and to the bottom edge of the front panel than about one quarter of the height of the front panel, and should be spaced inwardly and apart from an adjacent side edge of the front panel, so that when the envelope is bent so that it is convex toward the closure flap and the back panel, the pull-tab may be easily grasped in order to detach the tear strip with which the pull tab is integral and thus to easily open the envelope. This location of the pull tab is preferred in the envelope according to the invention described in this application because the pull tab is more easily grasped, especially by elderly people and persons with disabilities. In general, the pull tab preferably should at least be spaced from any edge of a front panel of an envelope according to my invention, as shown in FIGS. 4–14B of this application.

Many variations in the relative sizes and shapes of the component panels of an envelope according to the invention are possible so long as the security of the contents of the envelope are maintained when the envelope is sealed. It should be noted that, for example, the first side panel could be on the right when the envelope is seen from the back so that the tear panel is opened from right to left, which would be more convenient for left-handed recipients of the envelope.

Figure 5:
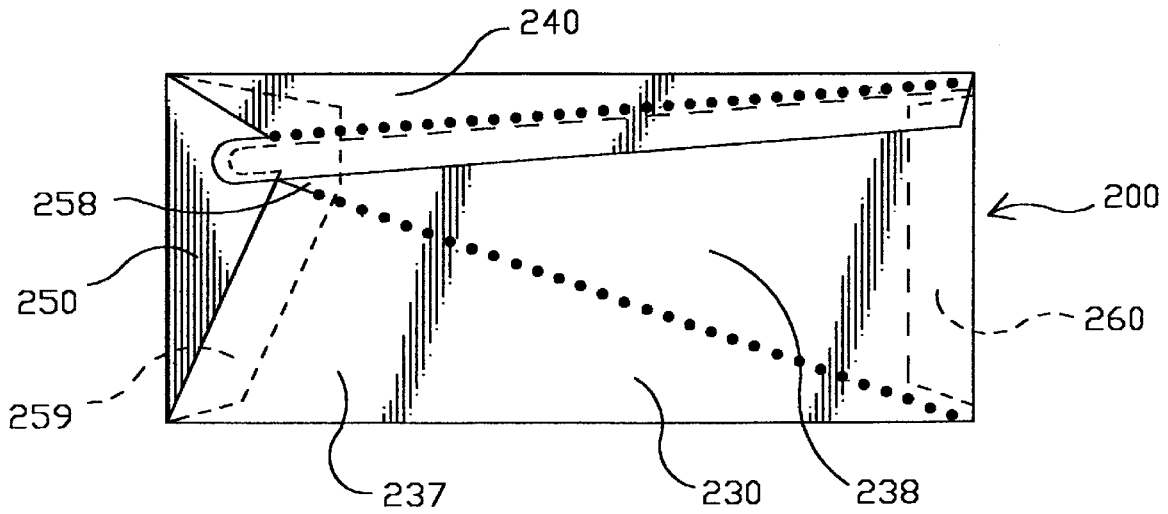
FIG. 5 is a plan view of the back of a variation of the preferred embodiment of the envelope shown in FIG. 4 having modified dimensions.

In FIG. 5 an envelope 200 is depicted that has the same general design as the envelope 100 of FIGS. 1–4, but with different dimensions and shapes of the back panel 230, the closure panel 240, and the first side panel 250. (The second side panel 260 is shown to have generally the same shape and dimensions as the second side panel 60 of the envelope 100 of FIGS. 1–4.) The first side panel 250, however, is sufficiently abbreviated in width that it need not be perforated or slotted as long as the portion 258 of the first side panel 250 (the portion of the first side panel 250 overlapped by the separable segment 238 of the back panel 230 and by the closure flap 240) is not glued to the separable segment 238 of the back panel 230. The portion 259 of the first side panel 250 is glued to the non-separable segment 237 of the back panel 230. The tear panel 270 will function in the same way as the tear panel 70 of the envelope 100 shown in FIGS. 1–4.

A tear panel formed by the provision of diverging lines of perforations commencing on either side of a pull tab or of mated pull tabs can be provided in other panels of an envelope in order to achieve the advantages of easier opening of the envelope and inspection/removal of its contents. FIGS. 6A through 14B show a number of embodiments of an easy-opening envelope according to the invention, each containing a tear panel defined by diverging lines of perforations commencing on either side of a pull tab or mated pull tabs.

Figure 6A:
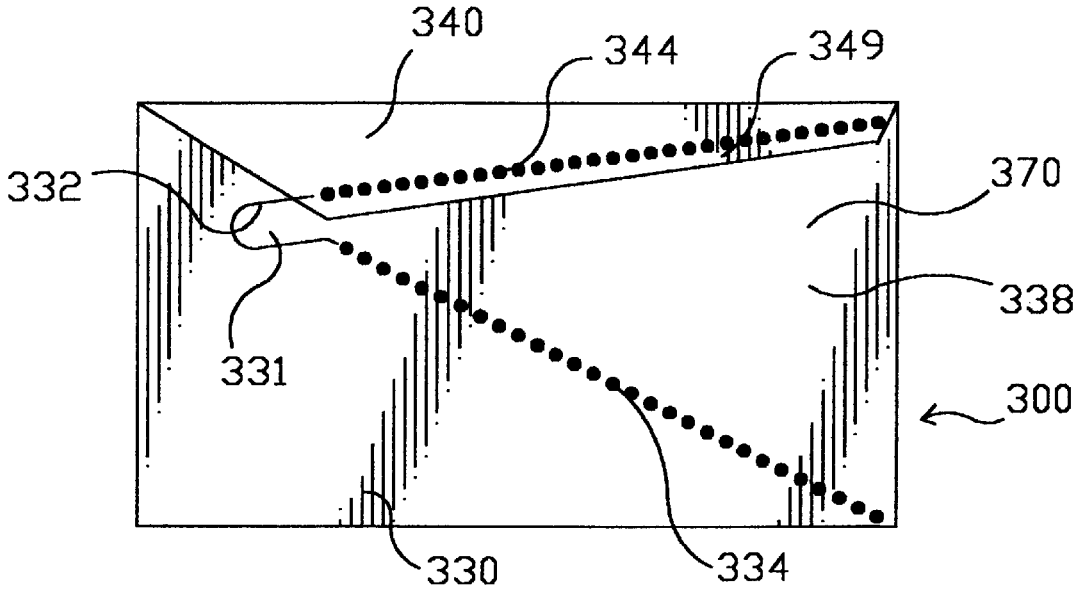
FIG. 6A is a plan view of the back of a second preferred embodiment of the envelope according to the invention with the closure panel in the closed position.
Figure 6B:
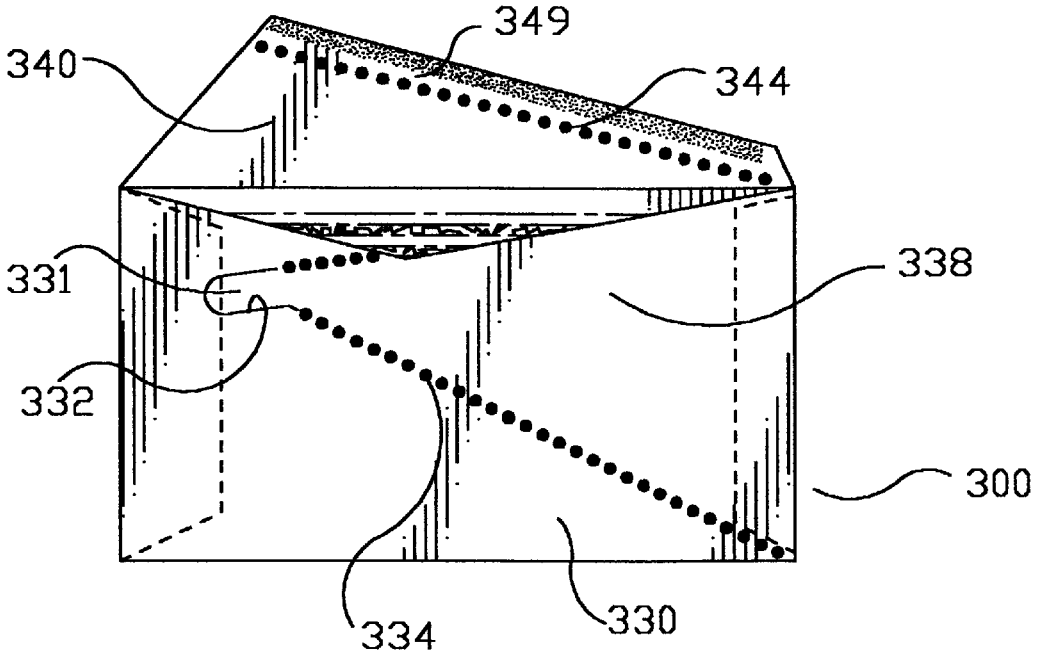
FIG. 6B is a plan view of the back of the same embodiment with the closure panel open.

FIGS. 6A and 6B show the back side of an embodiment 300 of the envelope according to the invention in which the tear panel 370 is formed from a separable segment 338 of the back panel 330 and a separable segment 349 of the closure panel 340. The tear panel 370 is partly bordered by diverging lines of perforations 334, 335, and 344. The pull tab 331 is formed entirely out of the back panel 330 by cutting a slot 332 through the back panel 330 around the pull tab 331 that joins the lines of perforations 334 and 335.

Figure 7A:
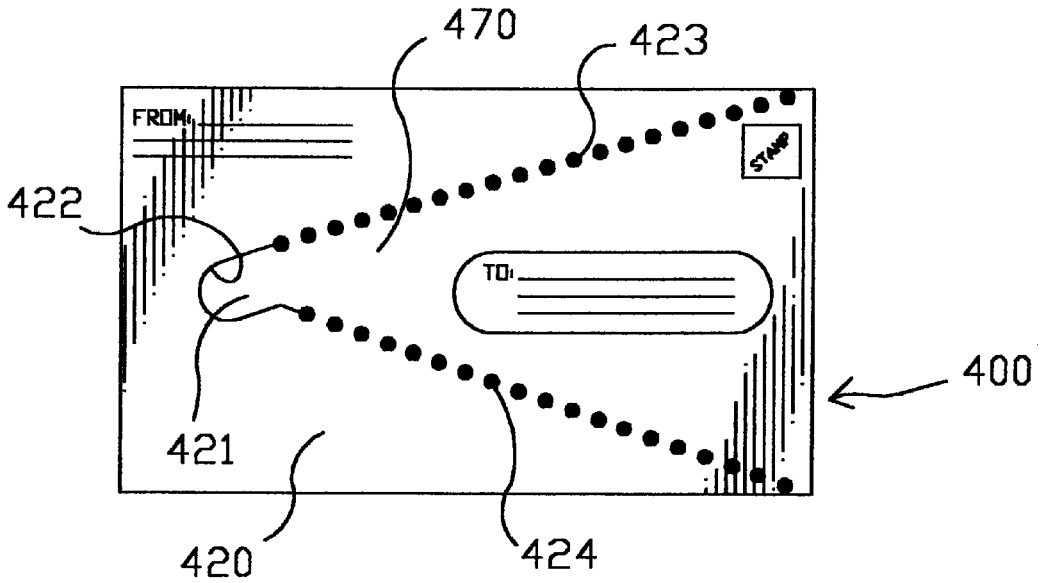
FIG. 7A is a plan view of the front of a third preferred embodiment of the envelope according to the invention.
Figure 7B:
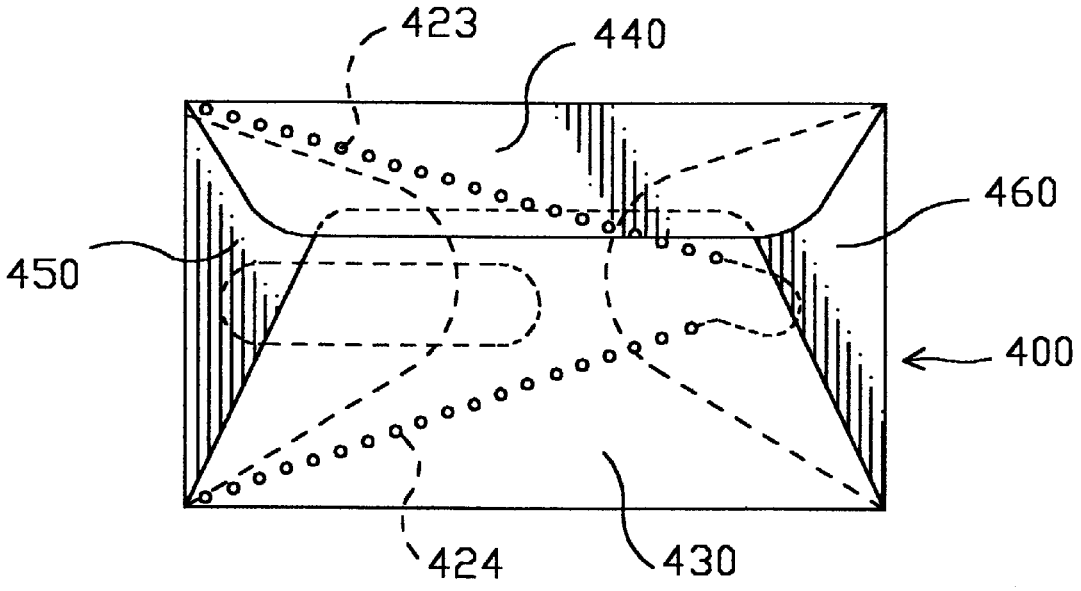
FIG. 7B is a plan view of the back of the same embodiment.

FIGS. 7A and 7B show the front and back, respectively, of an embodiment 400 of the envelope according to the invention. As shown in FIG. 7A, the tear panel 470 is formed exclusively in the front panel 420 in this embodiment 400 of the envelope according to the invention. The pull tab 421 is formed out of the front panel 420 by cutting a slot 422 through the front panel 420 around the pull tab 421 that joins the diverging lines of perforations 423 and 424. FIG. 7B shows the back side of the embodiment 400, showing a conventional arrangement of back panel 430, closure panel 440, and first and second side panels 450 and 460.

Figure 8A:
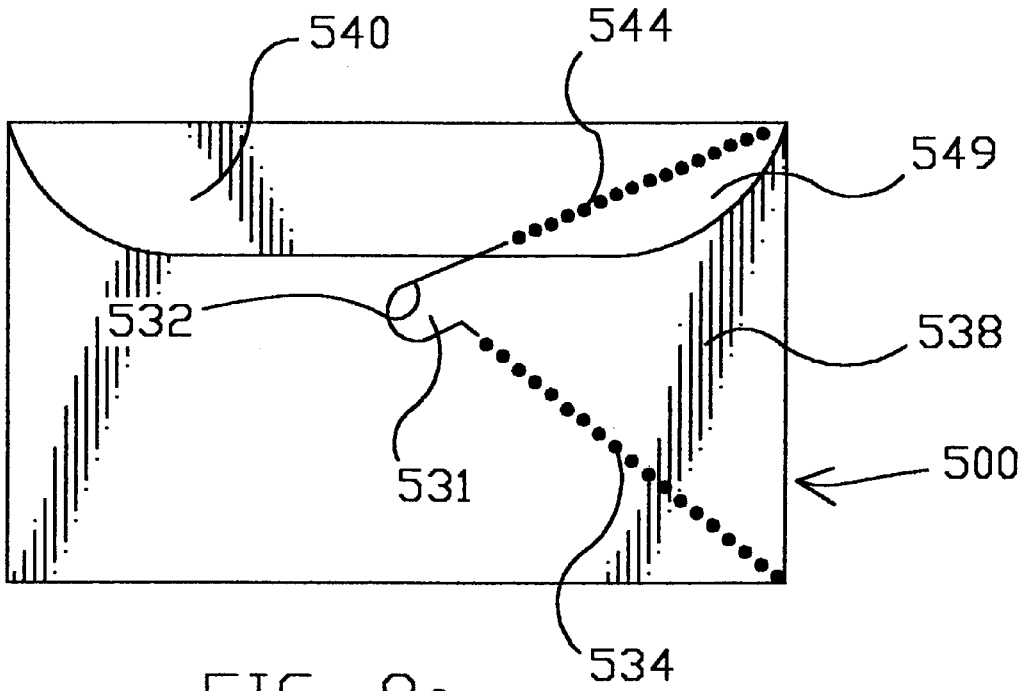
FIG. 8A is a plan view of the back of a fourth preferred embodiment of the envelope according to the invention with the closure panel closed.
Figure 8B:
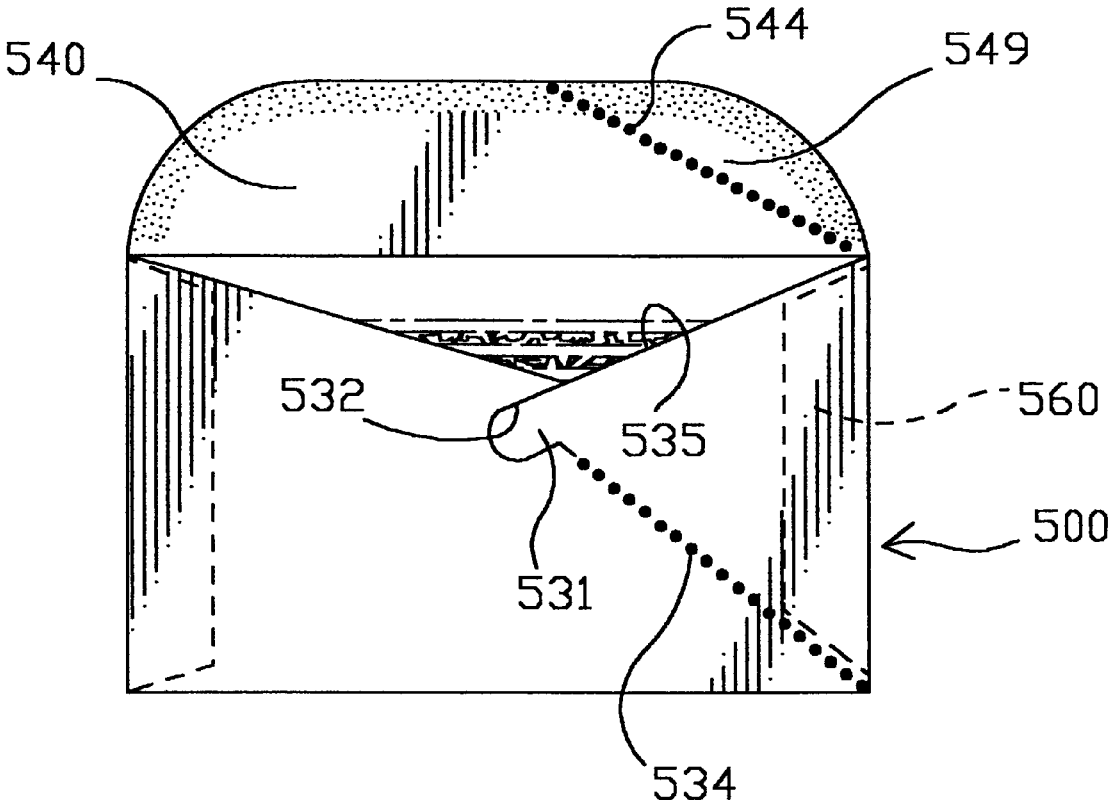
FIG. 8B is a plan view of the back of the same embodiment with the closure panel open.

FIGS. 8A and 8B show the back side of another embodiment 500 of the envelope according to the invention in which the tear panel 570 is formed from a combination of a separable segment 538 of the back panel 530, the second side panel 560, and a separable segment 549 of the closure panel 540. The diverging line of perforations 534 formed in the back panel 530 joins a slot 532 cut around pull tab 531. The separable segment 549 may be detached from the closure panel 540 along a line of perforations 544 that is parallel to and coincident with the top edge 535 of the back panel 530.

Figure 9A:
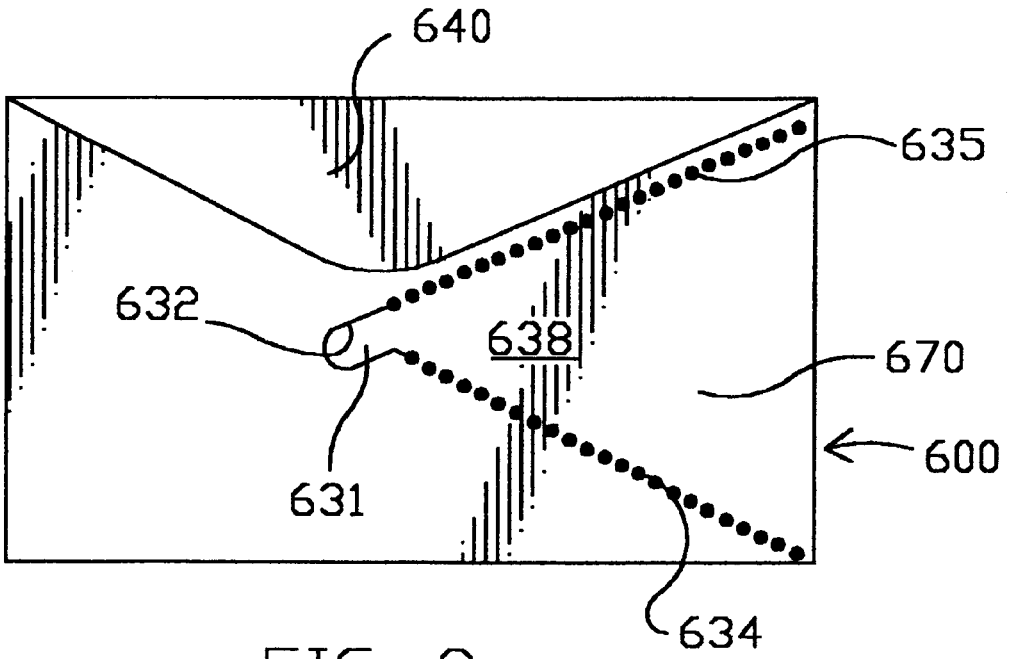
FIG. 9A is a plan view of the back of a fifth preferred embodiment of the envelope according to the invention with the closure panel closed.
Figure 9B:
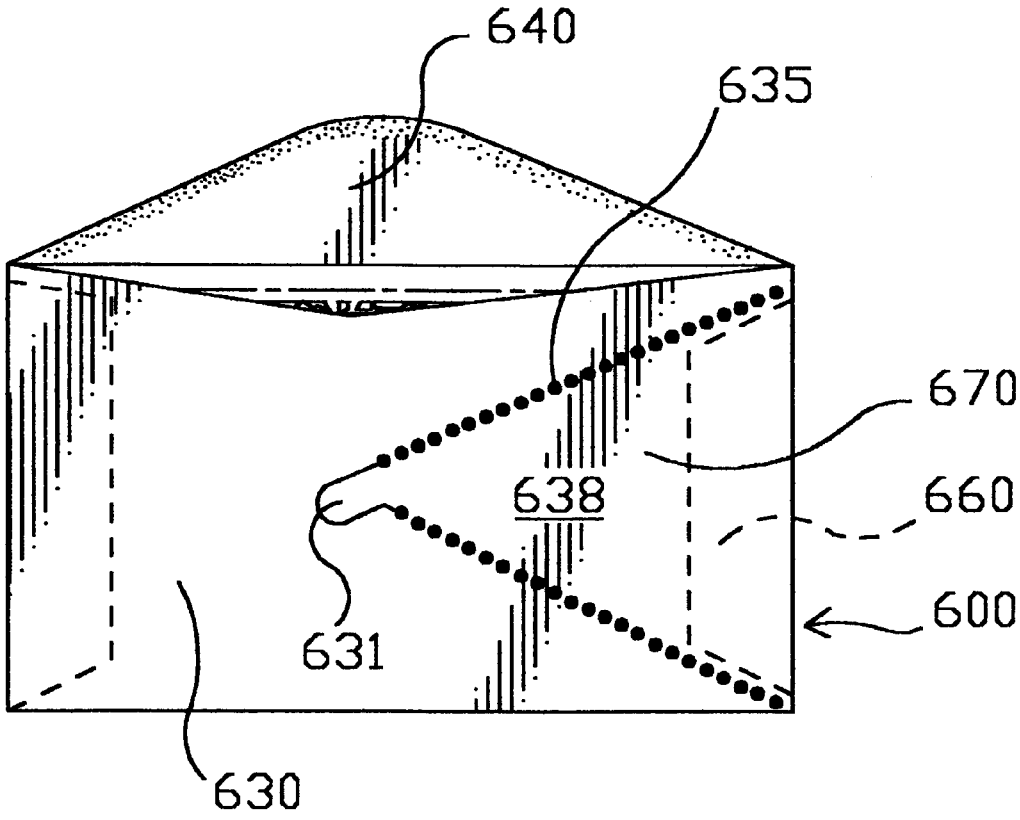
FIG. 9B is a plan view of the back of the same embodiment with the closure panel open.

FIGS. 9A and 9B show the back side of an embodiment 600 of the envelope according to the invention in which the tear panel 670 is formed from the combination of a separable segment 638 of the back panel 630 and the second side panel 660. The lines of perforations 634 and 635 in the back panel 630 diverge from a pull tab 631 defined by a slot 632 in the back panel 630. The closure panel 640 does not overlap the tear panel 670.

Figure 10A:
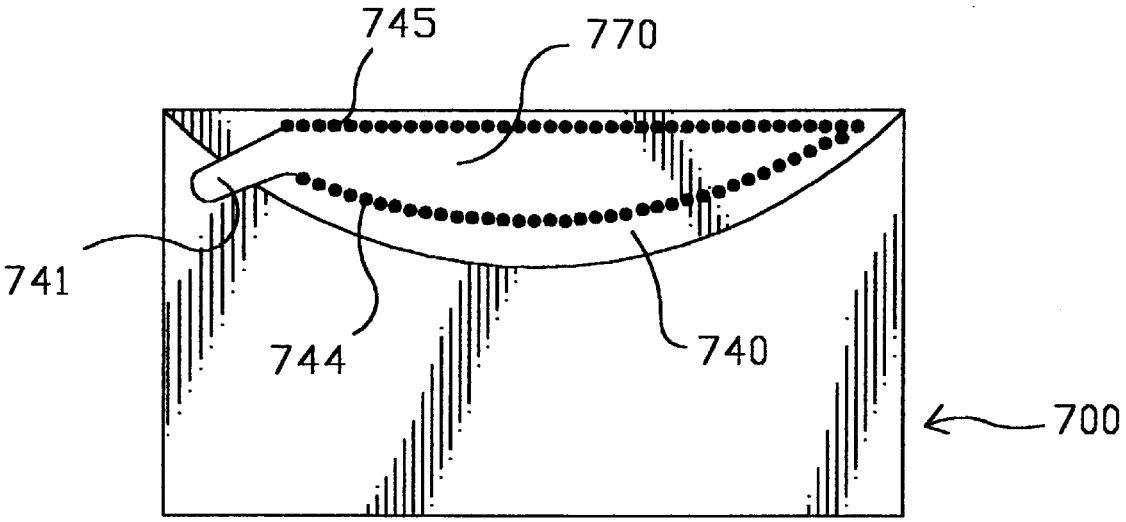
FIG. 10A is a plan view of the back of a sixth preferred embodiment of the envelope according to the invention.
Figure 10B:
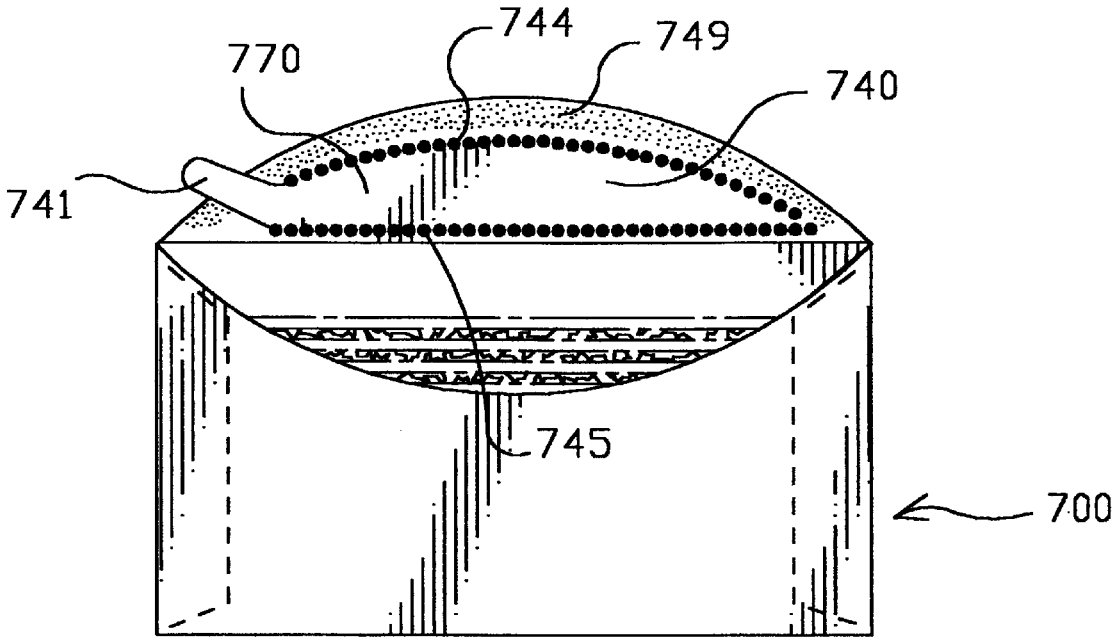
FIG. 10B is a plan view of the back of the same embodiment with the closure panel open.

FIGS. 10A and 10B show the back side of an embodiment 700 of the envelope according to the invention, with closure panel 740 closed and open, respectively. The tear panel 770 is formed exclusively in the closure panel 740. The lines of perforations 744 and 745 defining the tear panel 770 converge after first diverging from the pull tab 741 formed in the closure panel 740. The tear panel 770 avoids the glued area 749 of the closure panel 740, except for pull tab 741, which protrudes through the glued area 749 but does not have a glue layer on its inner side.

Figure 11A:
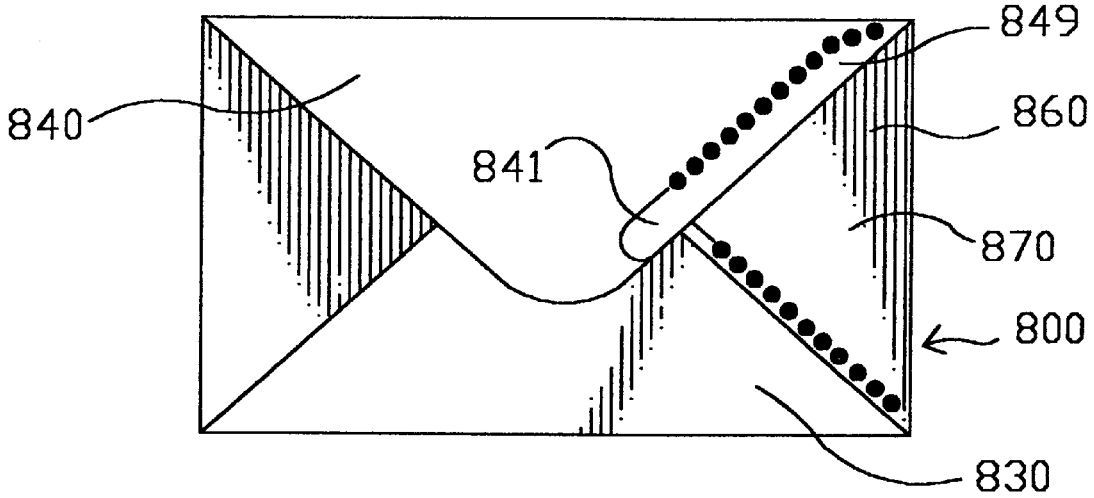
FIG. 11A is a plan view of the back of a seventh preferred embodiment of the envelope according to the invention with the closure panel closed.
Figure 11B:
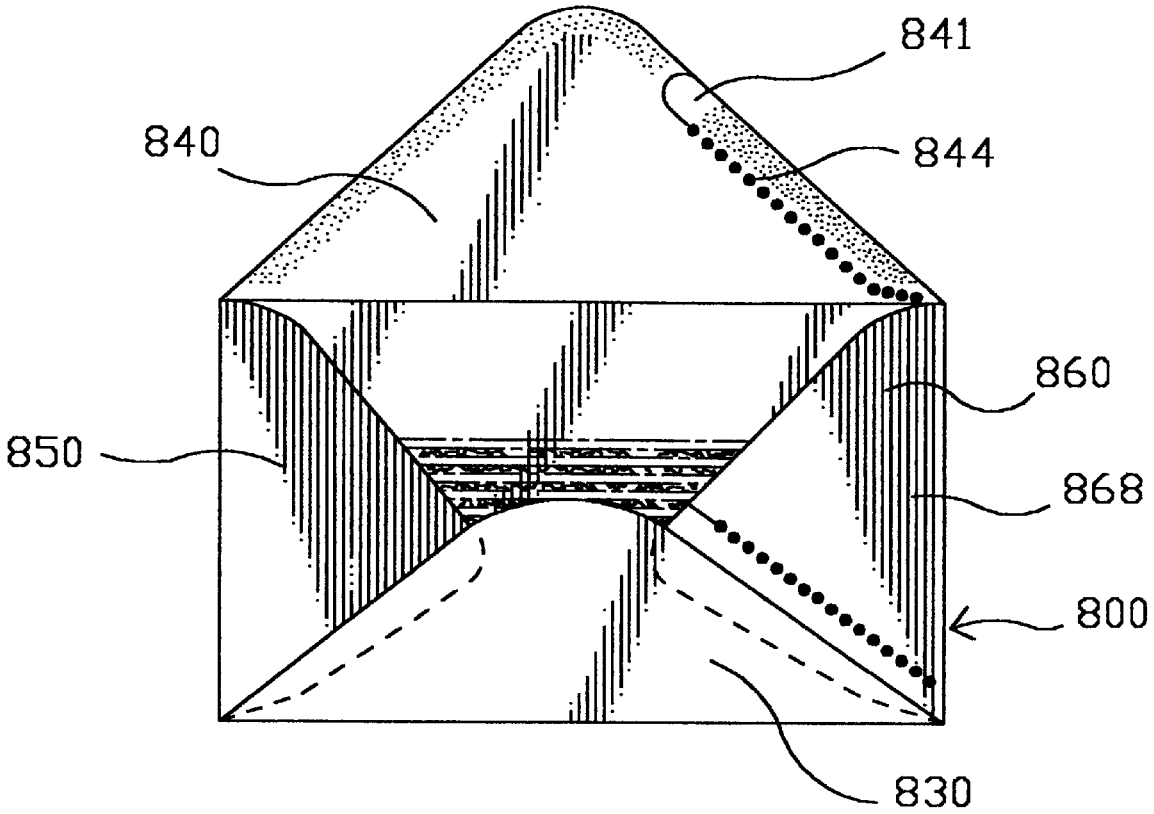
FIG. 11B is a plan view of the back of the same embodiment with the closure panel open.

FIGS. 11A and 11B show the back side of an embodiment 800 of the envelope according to the invention with closure panel 840 closed and open, respectively. In this embodiment, the tear panel 870 is formed from a combination of a separable segment 868 of the second side panel 860 and a separable segment 849 of the triangular closure panel 840. Pull tab 841 is formed as part of the separable segment 849 and does not have a layer of glue on its inside surface so that the pull tab 841 can be grasped by the forefinger and thumb of the recipient of the envelope 800. The lines of perforations 844 and 834, formed in the closure panel 840 and the back panel 830, respectively, diverge from the pull tab 841 and border the tear panel 870. The first and second side panels 850 and 860, respectively, and the back panel 830 of this embodiment 800 have generally triangular shapes.

Figure 12A:
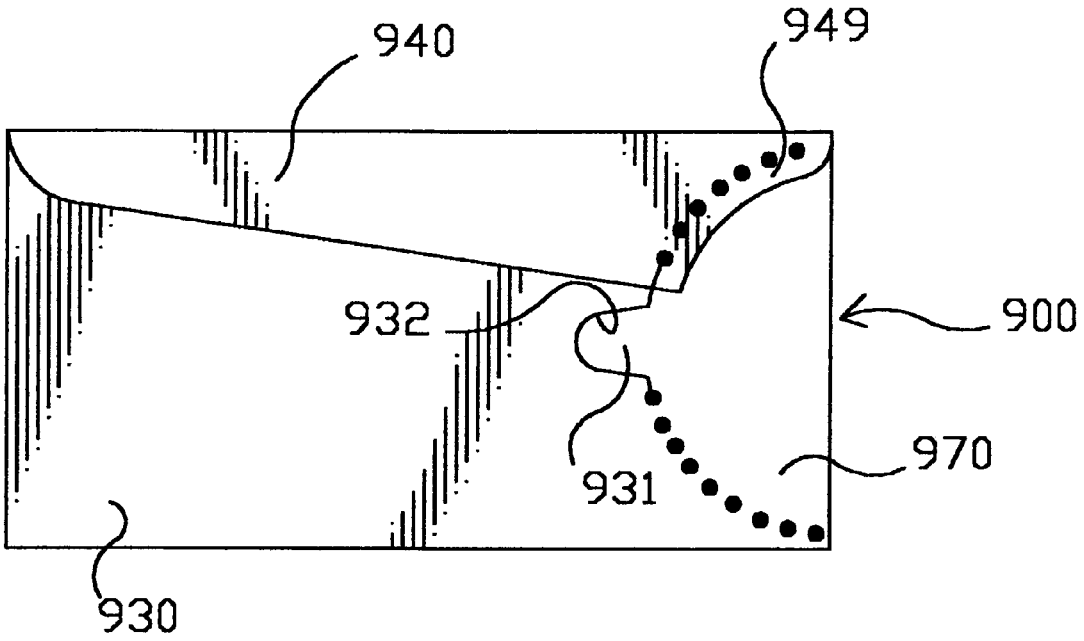
FIG. 12A is a plan view of the back of an eighth preferred embodiment of the envelope according to the invention with the closure panel closed.
Figure 12B:
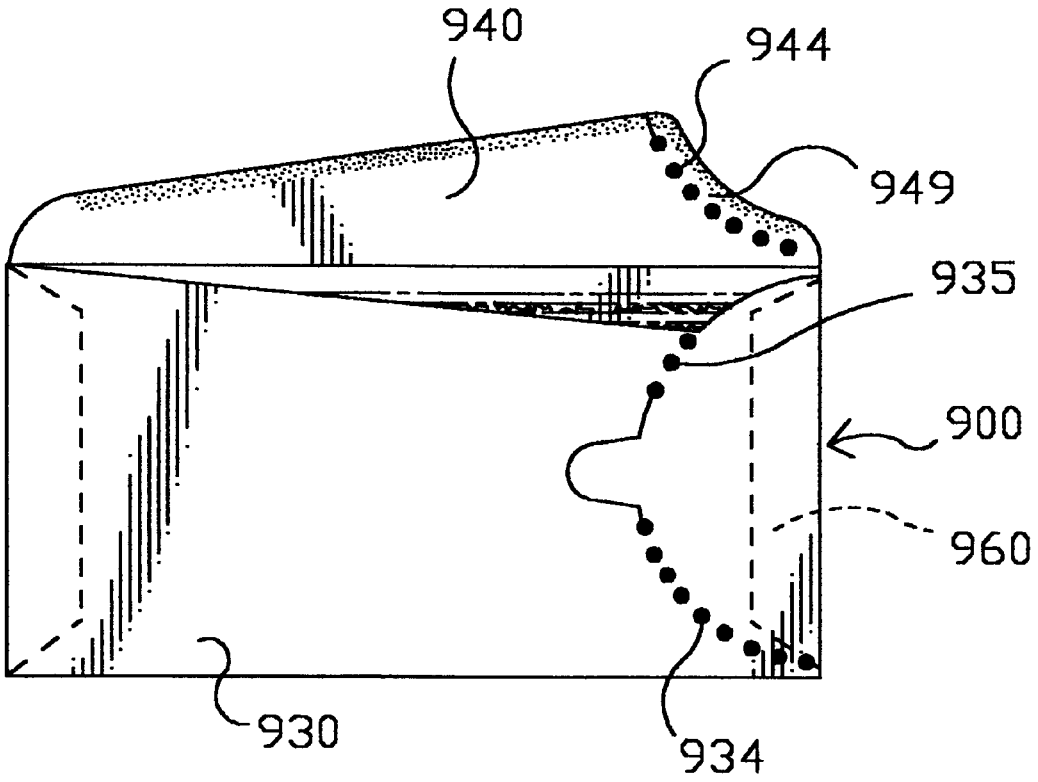
FIG. 12B is a plan view of the back of the same embodiment with the closure panel open.

FIGS. 12A and 12B show the back side with the closure panel closed and open, respectively, of an embodiment 900 of the envelope according to the invention. In this embodiment, the tear panel 970 is formed from a combination of a separable segment 938 of the back panel 930, the second side panel 960, and a separable segment 949 of the closure panel 940. The diverging lines of perforations 934, 935, and 944 are curved and the pull tab 931 is formed out of the back panel 930 by cutting a slot 932 through the same around the pull tab 931.

Figure 13A:
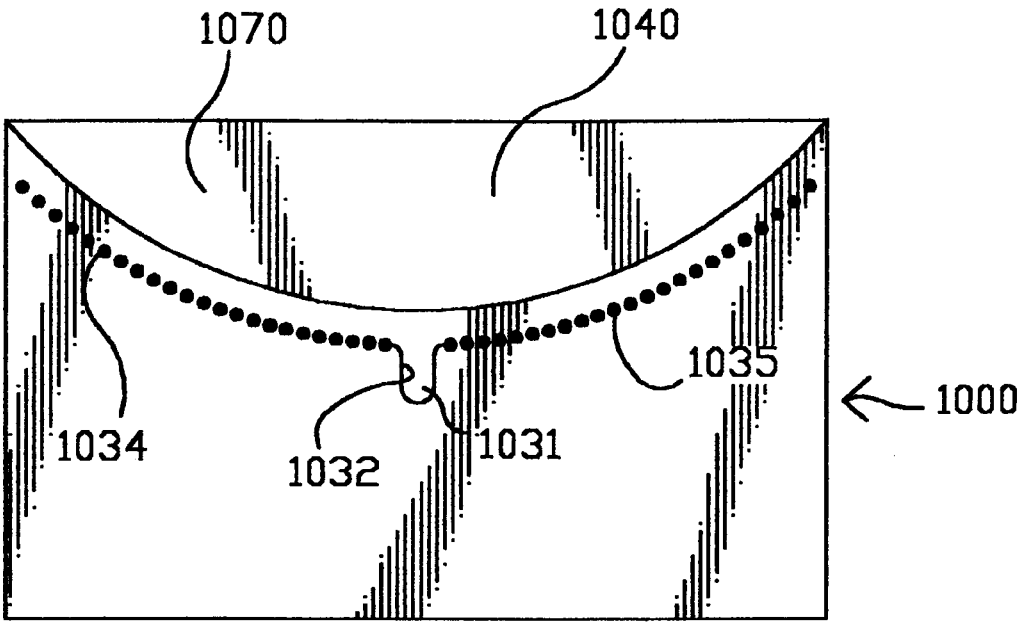
FIG. 13A is a plan view of the back of a ninth preferred embodiment of the envelope according to the invention with the closure panel closed.
Figure 13B:
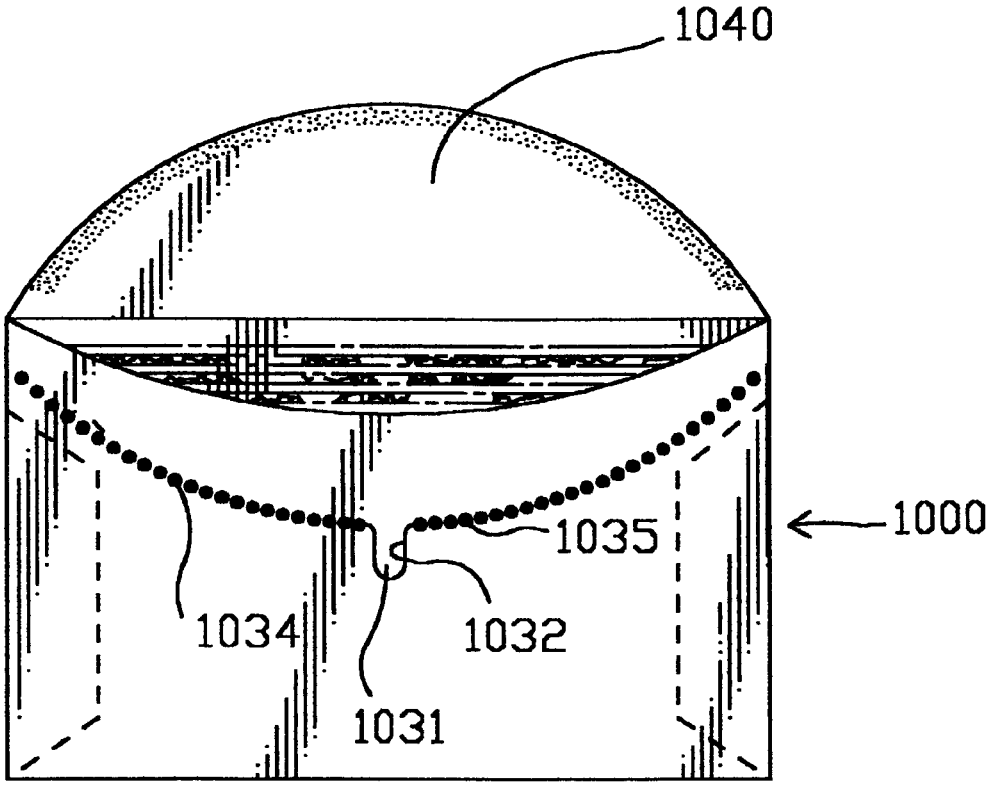
FIG. 13B is a plan view of the back of the same preferred embodiment with the closure panel open.

FIGS. 13A and 13B show the back, with closure panel closed and open, respectively, of an embodiment 1000 of the envelope according to the invention. In embodiment 1000, a tear panel 1070 is formed from a combination of a separable segment 1038 of the back panel 1030 and the entire closure panel 1040. The pull tab 1031 is formed from the back panel by cutting a slot 1032 through the back panel 1030 around the pull tab 1031. The slot 1032 joins the diverging lines of perforations 1034 and 1035.

Figure 14A:
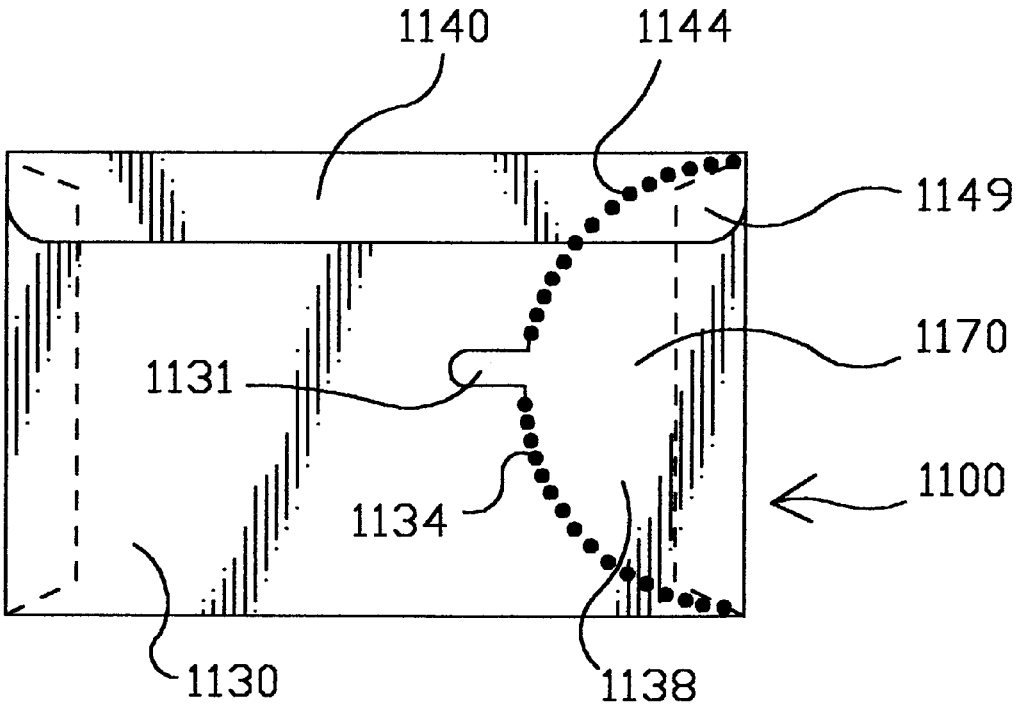
FIG. 14A is a plan view of the back of a tenth preferred embodiment of the envelope according to the invention with the closure panel closed.
Figure 14B:
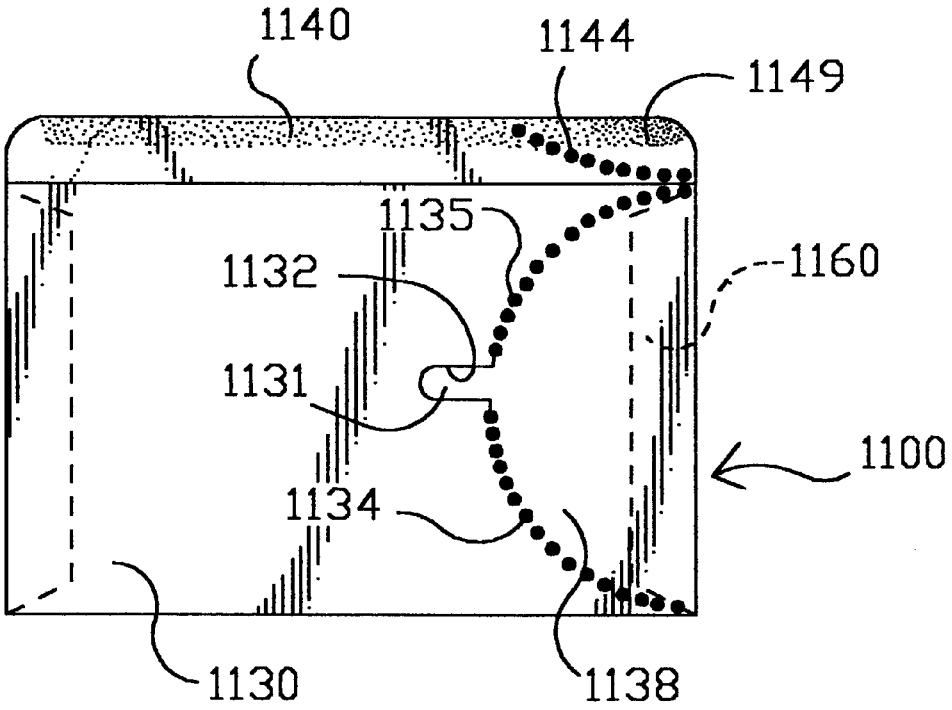
FIG. 14B is a plan view of the back of the same preferred embodiment with the closure panel open.

FIGS. 14A and 14B show the back side, with closure panel closed and open, respectively, of an embodiment 1100 of the envelope according to the invention. In embodiment 1100, the tear panel 1170 is formed from a combination of a separable segment 1138 of the back panel 1130, the second side panel 1160, and a separable segment 1149 of the closure panel 1140. The pull tab 1131 is formed from the back panel 1130 by cutting a slot 1132 through the material of the back panel 1130 around the pull tab 1131, and the lines of perforations 1134, 1135, and 1144 curvingly diverge from the pull tab 1131.

While the invention has been described in detail with respect to certain and preferred embodiments, it should be understood that the invention is not limited to those precise embodiments, and that those embodiments are instead representative examples of the many modifications and variations which present themselves to those skilled in the art to which the invention pertains without departing from the scope and spirit of this invention, as defined in the appended claims.

What is claimed is:

1. An easy-opening envelope for holding letters and other contents, comprising:

a rectangular front panel hingedly connected to a back panel and to a closure panel, the back panel and the closure panel being adhesively sealable to each other to secure the contents of the envelope, and a pull tab having an end and two sides and two lines of perforations formed in the back panel and the closure panel, the lines of perforations commencing on either side of the pull tab and divergingly extending away from the pull tab so as to define a tear panel between the lines of perforations which, upon separation at the lines of perforations, will open the envelope after sealing and expose the letter or other contents of the envelope for easy removal.

2. The envelope according to claim 1 in which one of the diverging lines of perforations is formed in the closure panel, the other line of perforations is formed in the back panel, and the pull tab is formed in the back panel, the closure panel, or both the back panel and the closure panel.

3. An easy-opening envelope comprising:

(a) a substantially rectangular planar front panel having opposed inner and outer surfaces, a top edge, a bottom edge, and first and second opposed side edges;

(b) a back panel having opposed inner and outer surfaces, a bottom edge, a top edge, and first and second opposed side edges generally adjacent, respectively, to the first and second side edges of the front panel, the bottom edge of the back panel being hingedly connected to the bottom edge of the front panel, the back panel having a line of perforations commencing at a pull tab formed in the back panel at an intersection of the first side edge of the back panel and the top edge of the back panel, the line of perforations in the back panel extending to the second side edge of the back panel and diverging away from the top edge of the back panel; and (c) a closure panel having opposed inner and outer surfaces, a first side edge adjacent the first side edge of the front panel, a top edge hingedly connected to the top edge of the front panel, a sealing edge, and the closure panel having a line of perforations parallel to the sealing edge and coincident with the top edge of the back panel when the closure panel is in sealing engagement with the back panel, the portions of the closure panel and back panel in sealing engagement between the lines of perforations thereby forming a tear panel which, upon separation of the lines of perforations, will open the envelope after sealing and expose the contents for easy removal.

4. The envelope according to claim 3 which a pull tab is formed in the closure panel at an intersection of the line of perforations in the closure panel with the first side edge of the closure panel.

* * * * *